US008944534B2

(12) United States Patent
Lim

(10) Patent No.: US 8,944,534 B2
(45) Date of Patent: Feb. 3, 2015

(54) REFRIGERATOR INCLUDES A SECOND DOOR DISPOSED ON A FIRST DOOR, A SHELF DISPOSED ON THE FIRST DOOR, A CONNECTION ASSEMBLY CONNECTING THE SHELF TO THE SECOND DOOR AND LINKING OPENING OF THE SECOND DOOR TO ROTATE THE SHELF

(75) Inventor: Kiyoung Lim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/817,837

(22) PCT Filed: Aug. 5, 2011

(86) PCT No.: PCT/KR2011/005749

§ 371 (c)(1),
(2), (4) Date: Feb. 20, 2013

(87) PCT Pub. No.: WO2012/023721

PCT Pub. Date: Feb. 23, 2012

(65) Prior Publication Data

US 2013/0147337 A1 Jun. 13, 2013

(30) Foreign Application Priority Data

Aug. 20, 2010 (KR) ..... 10-2010-0080752

(51) Int. Cl.
*F25D 23/04* (2006.01)
*F25D 23/02* (2006.01)
*F25D 25/02* (2006.01)

(52) U.S. Cl.
CPC ..... *F25D 23/028* (2013.01); *F25D 25/02* (2013.01); *F25D 2323/023* (2013.01); *F25D 23/04* (2013.01); *F25D 2323/024* (2013.01)
USPC ..... 312/292; 312/405.1

(58) Field of Classification Search
CPC ..... A47B 96/04; A47B 96/14; A47B 77/00; A47B 77/10; A47B 46/00; A47B 95/00; A47B 49/00; A47B 88/00; A47B 96/16; F25D 25/02; F25D 25/025; F25D 25/027
USPC ..... 312/404, 405–405.1, 291–292; 16/309, 16/312–313, 318
See application file for complete search history.

(56) References Cited

U.S. PATENT DOCUMENTS 1,275,511 A 8/1918 Welch
1,899,171 A * 2/1933 Warren ..... 312/275

(Continued)

FOREIGN PATENT DOCUMENTS

CN 1627016 A 6/2008
EP 0 539 558 A1 12/1992

(Continued)

OTHER PUBLICATIONS

U.S. Office Action dated Mar. 29, 2013 for U.S. Appl. No. 13/391,632, 10 pages.

(Continued)

*Primary Examiner* — Darnell Jayne
*Assistant Examiner* — Ryan A Doyle
(74) *Attorney, Agent, or Firm* — Fish & Richardson P.C.

(57) ABSTRACT

Provided is a refrigerator. The refrigerator includes a cabinet defining a storage space, a first door opening or closing the storage space, an accommodation device defining an accommodation space opened toward a front surface of the first door, a second door disposed on the first door to open or close the accommodation device, a shelf disposed on the first door, the shelf being spread to the outside of the accommodation device by the rotation thereof, and a connection assembly connecting the shelf to the second door, the connection assembly being linked with the opening of the second door to rotate the shelf. Thus, convenience of use may be improved.

16 Claims, 8 Drawing Sheets

(56) References Cited

U.S. PATENT DOCUMENTS

| | | | | | |
|---|---|---|---|---|---|
| 1,927,398 | A | | 9/1933 | Glasser | |
| 2,046,909 | A | | 7/1936 | Terry et al. | |
| 2,051,132 | A | * | 8/1936 | Dart | 62/441 |
| 2,062,360 | A | * | 12/1936 | Goulooze | 312/275 |
| 2,095,811 | A | * | 10/1937 | Goulooze | 312/274 |
| 2,112,771 | A | * | 3/1938 | Goulooze | 312/275 |
| 2,118,735 | A | * | 5/1938 | Money | 62/329 |
| 2,122,501 | A | * | 7/1938 | Thomas | 312/242 |
| 2,129,923 | A | | 9/1938 | Mortimer | |
| 2,130,617 | A | | 9/1938 | Dockham | |
| 2,131,680 | A | | 9/1938 | Zahodiakin | |
| 2,135,878 | A | | 11/1938 | Sekyra | |
| 2,150,064 | A | * | 3/1939 | Robert et al. | 62/266 |
| 2,213,274 | A | | 9/1940 | Flamm | |
| 2,276,937 | A | | 3/1942 | Arturo | |
| 2,653,851 | A | * | 9/1953 | Davidson | 312/348.6 |
| 2,692,813 | A | * | 10/1954 | Toronto | 312/408 |
| 3,140,134 | A | | 7/1964 | Nairn | |
| 3,218,111 | A | | 11/1965 | Steiner | |
| 3,389,424 | A | | 6/1968 | Fellwock | |
| 3,510,986 | A | | 5/1970 | Berkowitz | |
| 3,639,944 | A | * | 2/1972 | Mott et al. | 16/318 |
| 3,836,221 | A | | 9/1974 | Whistler | |
| 4,087,140 | A | * | 5/1978 | Linstromberg | 312/292 |
| 4,215,449 | A | * | 8/1980 | Loikitz | 16/50 |
| 4,302,907 | A | | 12/1981 | Canals et al. | |
| 4,368,622 | A | | 1/1983 | Brooks | |
| 4,514,021 | A | | 4/1985 | Sundermeier et al. | |
| 4,639,051 | A | * | 1/1987 | DeBruyn | 312/275 |
| 4,917,446 | A | * | 4/1990 | Mariani | 312/325 |
| 5,111,618 | A | | 5/1992 | Kaspar | |
| 5,138,743 | A | * | 8/1992 | Hoffman | 16/303 |
| 5,209,082 | A | * | 5/1993 | Ha | 62/265 |
| 5,458,412 | A | * | 10/1995 | Lee et al. | 312/309 |
| RE35,120 | E | | 12/1995 | Heaney | |
| 5,474,374 | A | * | 12/1995 | Sandvig | 312/274 |
| 5,584,902 | A | | 12/1996 | Hartig | |
| 5,902,028 | A | * | 5/1999 | Hsu et al. | 312/271 |
| 5,966,963 | A | | 10/1999 | Kovalaske | |
| 6,055,823 | A | | 5/2000 | Baker et al. | |
| 6,268,594 | B1 | | 7/2001 | Leutner et al. | |
| 6,375,291 | B1 | | 4/2002 | Nam et al. | |
| 6,721,991 | B2 | * | 4/2004 | Dioguardi | 16/228 |
| 6,722,142 | B1 | | 4/2004 | Pagel | |
| 7,008,032 | B2 | | 3/2006 | Chekal | |
| 7,360,374 | B2 | | 4/2008 | LaRose | |
| 7,377,123 | B2 | | 5/2008 | Byrne et al. | |
| 2001/0035024 | A1 | * | 11/2001 | Dasher et al. | 62/440 |
| 2002/0062533 | A1 | * | 5/2002 | Huang | 16/50 |
| 2004/0100175 | A1 | * | 5/2004 | Choi | 312/404 |
| 2004/0137235 | A1 | | 7/2004 | Paul | |
| 2004/0211211 | A1 | * | 10/2004 | Nam et al. | 62/440 |
| 2004/0250377 | A1 | | 12/2004 | Park | |
| 2005/0188506 | A1 | | 9/2005 | Lee et al. | |
| 2005/0258724 | A1 | | 11/2005 | Hwa | |
| 2006/0005484 | A1 | | 1/2006 | Riblier et al. | |
| 2006/0144075 | A1 | | 7/2006 | Bowen et al. | |
| 2006/0201192 | A1 | | 9/2006 | Bowen et al. | |
| 2006/0226750 | A1 | | 10/2006 | Lee | |
| 2006/0244350 | A1 | | 11/2006 | Martin et al. | |
| 2006/0265979 | A1 | | 11/2006 | Cording | |
| 2007/0018548 | A1 | | 1/2007 | Ertz et al. | |
| 2008/0006042 | A1 | | 1/2008 | Lee | |
| 2009/0075069 | A1 | | 3/2009 | Myli | |
| 2009/0255291 | A1 | | 10/2009 | Lee | |
| 2009/0261701 | A1 | * | 10/2009 | Yun et al. | 312/405 |
| 2009/0272136 | A1 | | 11/2009 | Knoell | |
| 2010/0084952 | A1 | * | 4/2010 | Sagel | 312/238 |
| 2010/0107679 | A1 | | 5/2010 | Park et al. | |
| 2010/0308705 | A1 | * | 12/2010 | Kwon et al. | 312/404 |
| 2011/0187255 | A1 | * | 8/2011 | Ryu et al. | 312/405 |
| 2012/0060544 | A1 | * | 3/2012 | Lee et al. | 62/440 |

FOREIGN PATENT DOCUMENTS

| | | | |
|---|---|---|---|
| JP | 56-164495 | U | 12/1981 |
| JP | 63-142682 | U | 9/1988 |
| JP | 06-066473 | A | 3/1994 |
| JP | 10-009757 | A | 1/1998 |
| JP | 2000-065459 | A | 3/2000 |
| JP | 2001-108357 | A | 4/2001 |
| JP | 2002-323287 | A | 11/2002 |
| JP | 2006-038437 | A | 2/2006 |
| JP | 2009-103395 | A | 5/2009 |
| KR | 1990-0008203 | Y1 | 9/1990 |
| KR | 1996-0011364 | A | 4/1996 |
| KR | 1999-042339 | A | 6/1999 |
| KR | 1999-062159 | A | 7/1999 |
| KR | 1999-037440 | A | 10/1999 |
| KR | 1999-0039593 | A | 11/1999 |
| KR | 20-0164322 | Y1 | 2/2000 |
| KR | 20-0168373 | Y1 | 2/2000 |
| KR | 2002-0083115 | A | 11/2002 |
| KR | 10-0376167 | B1 | 3/2003 |
| KR | 20-0314145 | Y1 | 5/2003 |
| KR | 2003-0083813 | A | 11/2003 |
| KR | 2005-0111094 | A | 11/2005 |
| KR | 10-0596533 | B1 | 7/2006 |
| KR | 10-0733309 | B1 | 6/2007 |
| KR | 10-0887575 | B1 | 3/2009 |
| KR | 2009-0077564 | A | 7/2009 |
| WO | WO 2004/059228 | A1 | 7/2004 |

OTHER PUBLICATIONS

U.S. Office Action dated Jul. 1, 2013 for U.S. Appl. No. 13/390,946, 24 pages.

International Search Report dated Dec. 27,2011 for Application No. PCT/KR2011/005749, 2 pages.

European Search Report dated May 9, 2014 for Application No. 11818321.9, 8 pages.

Russian Notice of Allowance dated Jun. 2, 2014 for Russian Application No. 2013112332/13(018287), in English, 4 pages.

Chinese Office Action dated Jul. 21, 2014 for Chinese Application No. 201180040376.X, in English, 6 pages.

* cited by examiner

REFRIGERATOR INCLUDES A SECOND DOOR DISPOSED ON A FIRST DOOR, A SHELF DISPOSED ON THE FIRST DOOR, A CONNECTION ASSEMBLY CONNECTING THE SHELF TO THE SECOND DOOR AND LINKING OPENING OF THE SECOND DOOR TO ROTATE THE SHELF

CROSS-REFERENCE TO RELATED APPLICATIONS

This application is a U.S. National Phase Application under 35 U.S.C. §371 of International Application PCT/KR2011/005749, filed on Aug. 5, 2011, which claims the benefit of Korean Application No. 10-2010-0080752, filed on Aug. 20, 2010, the entire content of each application is hereby incorporated by reference.

TECHNICAL FIELD

Embodiments relate to a refrigerator.

BACKGROUND ART

A refrigerator is a home appliance providing a low-temperature storage that can be opened and closed by a door for storing foods at a low temperature. For this, the refrigerator cools the inside of the storage space using cool air generated by heat-exchanging with a refrigerant that circulates a cooling cycle to store the foods in an optimum state.

The size of the refrigerator tends to increase more and more and multi-functions are provided to the refrigerator as dietary life changes and pursues high quality, and accordingly, refrigerators of various structures with consideration of user convenience and energy efficiency are brought to the market.

DISCLOSURE OF INVENTION

Technical Problem

Embodiments provide a refrigerator including a shelf which is spread by being linked with an opening/closing operation of a second door for opening or closing a storage space defined in a first door for covering the storage space.

Solution to Problem

In one embodiment, a refrigerator includes: a cabinet defining a storage space; a first door opening or closing the storage space; an accommodation device defining an accommodation space opened toward a front surface of the first door; a second door disposed on the first door to open or close the accommodation device; a shelf disposed on the first door, the shelf being spread to the outside of the accommodation device by the rotation thereof; and a connection assembly connecting the shelf to the second door, the connection assembly being linked with the opening of the second door to rotate the shelf.

Both left and right side surfaces of the shelf may be shaft-coupled to an opening defining an inlet of the accommodation device in the first door.

The second door may have a shelf receiving part stepped to receive the shelf when the shelf is folded.

The connection assembly may have a variable length.

Both ends of the connection assembly may be rotatably coupled to the shelf and the second door, respectively.

A damping unit which absorbs shock of the shelf during the rotation of the shelf to reduce a rotation speed of the shelf may be further disposed on the connection assembly.

A joint member to which an end of the connection assembly having a ball shape is rotatably coupled may be disposed on the shelf.

The joint member may include: a cutout part which is cut so that an end of the connection assembly is rotatably; and a guide part protruding from a side of the cutout part to receive ends of the connection assembly into both ends of the cutout part.

The connection assembly may include: a joint rod rotatably coupled to the joint member; a rod in which the joint rod is accessibly received; a mounting member mounted on the second door; and a connection member rotatably connected to the mounting member and the rod.

The connection member may include: a connection member rotation shaft connecting the mounting member to the connection member to rotate the connection member in the same direction as that in which the second door is rotated; and a rod shaft connecting the connection member to the rod to rotate the rod in a direction crossing that in which the second door is rotated.

The refrigerator may further include a damping unit elastically supporting the joint rod inside the rod to decelerate the rod.

The refrigerator may further include a lower hinge assembly disposed on a rotation shaft of the second door, the lower hinge assembly being rotated along an inclined cam surface by a self-weight of the second door when the second door is opened to open the second door.

The lower hinge assembly may include: a hinge fixing part fixed to an extending line of the rotation shaft of the second door; a hinge rotation part vertically movable above the hinge fixing part, the hinge rotation part being rotated together with the second door; and an elastic member supporting the hinge rotation part upward, the elastic member providing an elasticity to maintain a contact state between the hinge rotation part and the hinge fixing part.

First and second cam surfaces inclined downward may be disposed on the hinge fixing part and the hinge rotation part, respectively, and the first and second cam surfaces may contact each other in a state where the second door is closed to rotate the second door by a self-weight of the second door during the opening of the second door.

Second and fourth cam surfaces inclined upward may be disposed on the hinge fixing part and the hinge rotation part, respectively, and the second and fourth cam surfaces may contact each other when the second door is opened at an angle greater than a preset angle to reduce and restrict the rotation of the second door.

Advantageous Effects of Invention

According to the embodiments, the shelf may be spread by being linked with the opening of the second door. Thus, the user may place the foods to be accommodated in the accommodation device on the spread shelf to more easily accommodate the foods.

Also, the shelf may be smoothly rotated by the connection assembly connected to the shelf. In addition, it may prevent the second door from being rotated at an angle greater than the preset angle through the lower hinge assembly to spread the shelf into the stable state.

MODE FOR THE INVENTION

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

For convenience of description, although a side-by-side type refrigerator is described as an example in embodiments, the present disclosure is not limited thereto. For example, all types of refrigerator including a door openable by rotation thereof may be applied to the embodiments.

Figure 1:
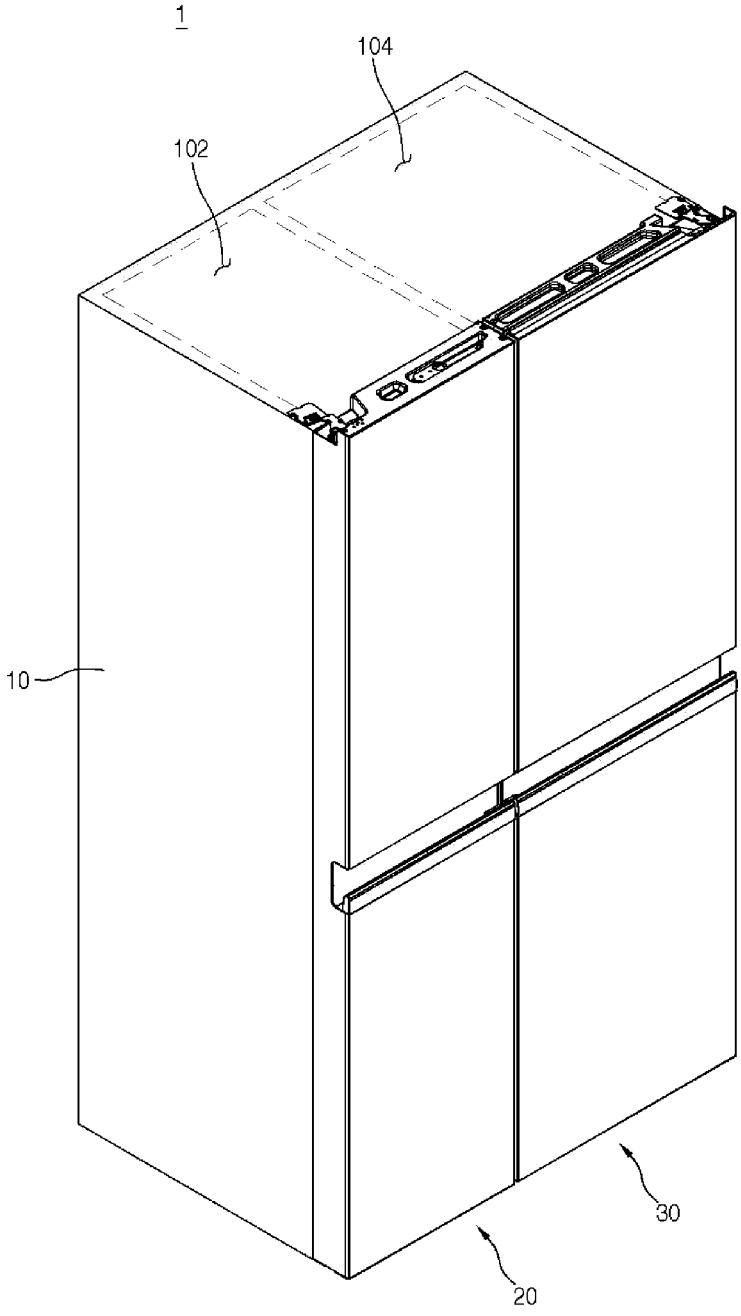
FIG. 1 is a perspective view of a refrigerator according to an embodiment.
Figure 2:
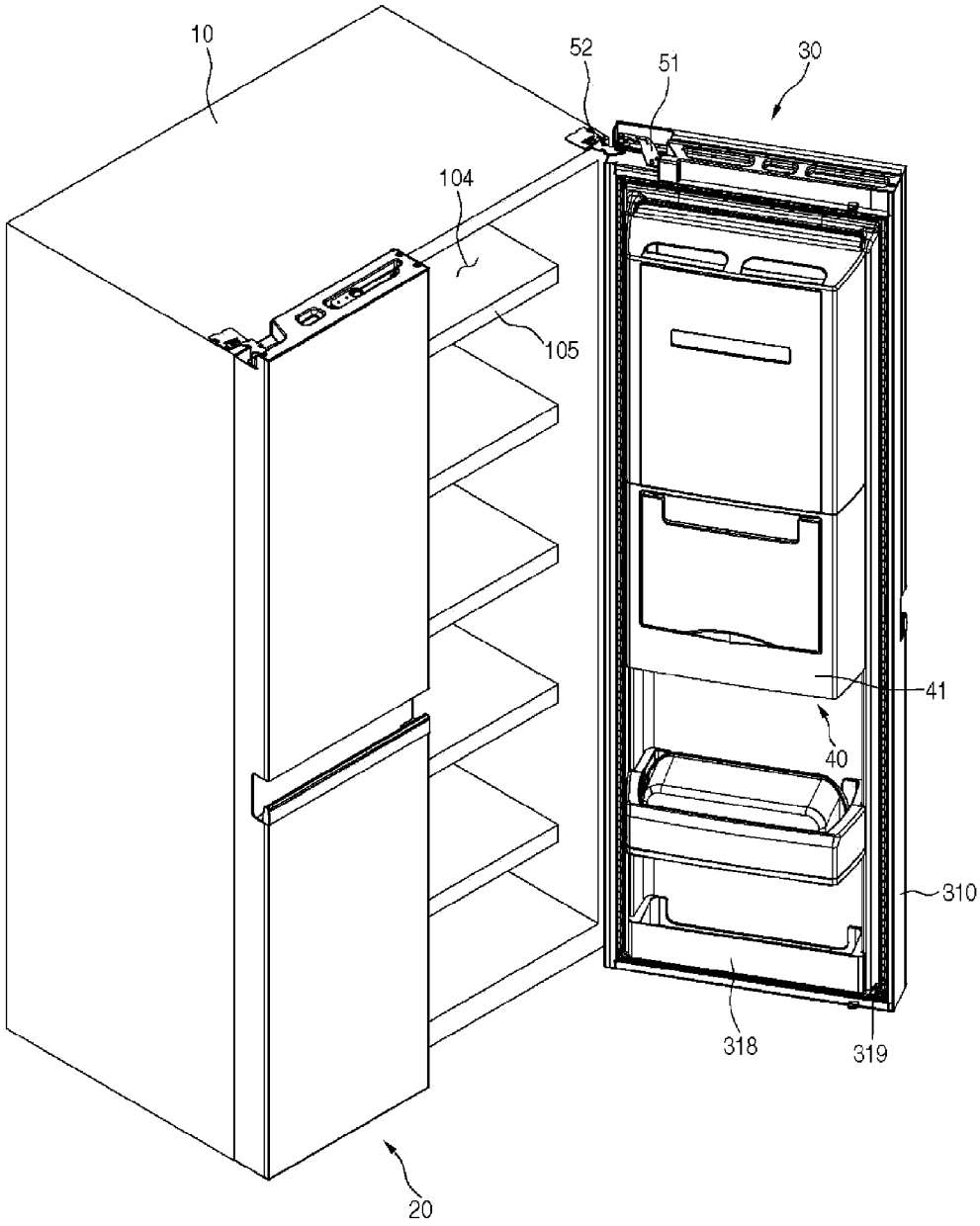
FIG. 2 is a perspective view of a refrigerator with a first door opened according to an embodiment.
Figure 3:
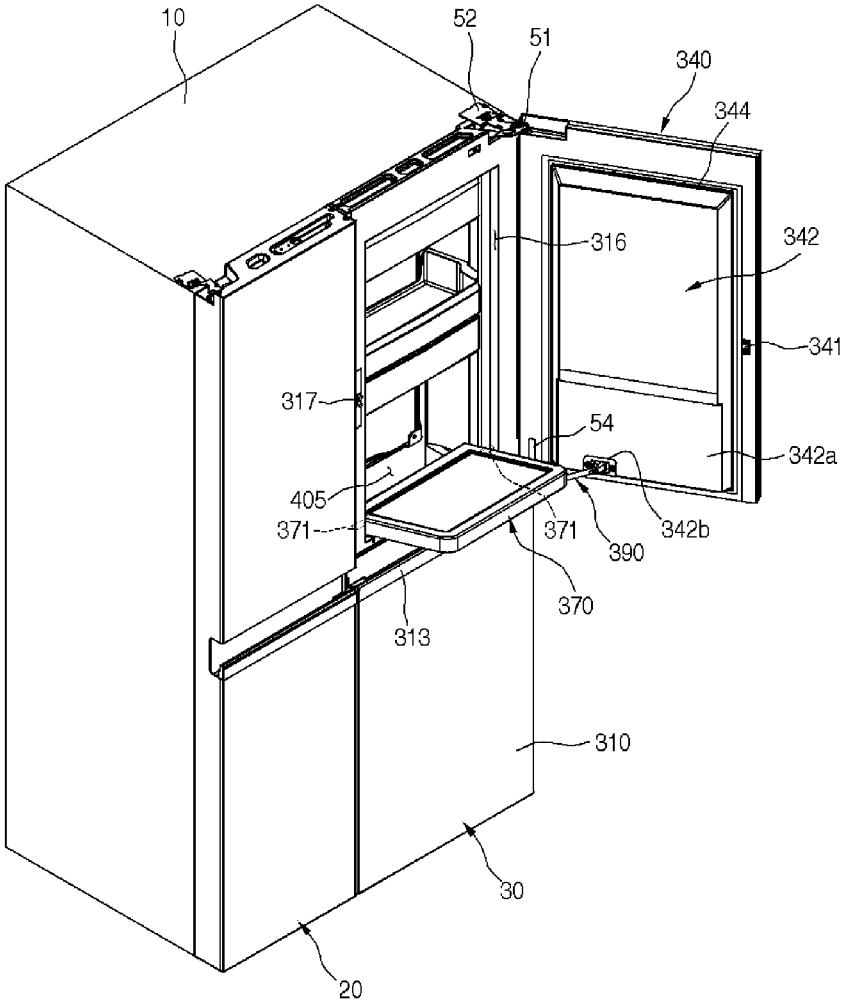
FIG. 3 is a perspective view of a refrigerator with a second door opened according to an embodiment.

FIG. 1 is a perspective view of a refrigerator according to an embodiment. FIG. 2 is a perspective view of a refrigerator with a first door opened according to an embodiment. FIG. 3 is a perspective view of a refrigerator with a second door opened according to an embodiment.

Referring to FIGS. 1 to 3, a refrigerator 1 according to an embodiment includes a cabinet defining a storage space and doors 20 and 30 opening or closing the storage space. Here, an outer appearance of the refrigerator 1 may be defined by the cabinet 10 and the doors 20 and 30.

The inside of the cabinet 10 may be partitioned into left and right sides to define a freezing compartment 102 and a refrigerating compartment 104. The doors 20 and 30 may include a freezing compartment door 20 and a refrigerating compartment door 30, which open and close the freezing compartment 102 and the refrigerating compartment 104, respectively.

Also, an accommodation device for defining a separate storage space separated from the inside of the refrigerating compartment 104 may be disposed on the refrigerating compartment door 30. Thus, in a state where the refrigerating compartment door 30 is closed, the inside of the refrigerating compartment 104 may be defined as a first storage compartment 104 and the inside of the accommodation device may be defined as a second storage compartment 405.

The refrigerating compartment door 30 may include a first door 310 opening or closing the first storage compartment 104 and a second door 340 for opening or closing the second storage compartment 405.

In detail, an opening 316 may be defined in an upper portion of the first door 310. The opening 316 may extend from a grip part 313 up to a position adjacent to an upper end of the first door 310. Also, the opening 316 may extend up to a position adjacent to each of both side ends of the first door 310. The accommodation device 40 may be disposed on a rear surface of the first door 310 corresponding to a rear side of the opening 316. The accommodation device 40 has a shape opened in a front direction. Also, foods may be accessible into the accommodation device 40 through the opening 316.

A sealer 319 may be disposed around a rear surface of the refrigerating compartment door 30 to contact a circumference of a front surface of the cabinet 10 when the refrigerating compartment door 30 is closed. The sealer 319 may be formed of an elastically deformable and compressible material. Also, a magnet may be disposed inside the sealer 319 and thus closely attached to the cabinet 10.

Also, an opening 316 through which foods accommodated into the accommodation device 40 is accessible in a state where the first door 310 is closed may be defined in the refrigerating compartment door 30. Thus, in a state where the first door 310 covers the refrigerating compartment 104, the opening 316 may be opened to take the food in or out the accommodation device 40.

The opening 316 may have a size corresponding to that of a front surface of the accommodation device 40. The opening may be vertically defined from an upper end of the first door 310 up to a position of the grip part 313 and horizontally defined up to a region except for a portion of each of both side ends of the first door 310. Thus, the opening 316 may be significantly different from a home bar used in a general refrigerator in size and usage.

The second door 340 may open or close the opening 316. Also, the second door 340 may be rotatably disposed on the first door 310 by a first hinge 51. The first hinge 51 may be disposed on the upper end of the refrigerating compartment door 30 and the front surface of the refrigerating compartment door 30 corresponding to a lower side of the opening 316. The first hinge 51 is shaft-coupled to upper and lower ends of the second door 340. Thus, the second door 340 may be independently rotatable in a state where the first door 310 is closed to selectively open or close the opening 316.

The second door 340 may have a front surface formed of the same material as those of the first door 310 and the freezing compartment door 20. Also, a design or pattern may be continuously disposed on the front surface of the second door 340. When the second door 340 is closed, the front surface of the second door 340 may be disposed on the same plane as that of the front surface of the refrigerating compartment door 30 disposed at the lower side of the second door 340.

Also, when the second door 340 is closed, the upper end and both side ends of the second door 340 may be disposed at the same position as those of the refrigerating compartment door 30. The lower end of the second door 340 may extend up to a position corresponding to an area on which the grip part 313 of the refrigerating compartment door 30 is disposed. That is, the lower end of the second door 340 may extend up to a position corresponding to a stepped portion on an area in which the grip part 313 of the freezing compartment door 20 is disposed. Thus, the second door 340 may be integrated with the first door 310 in the state where the second door 340 is closed. Also, when viewed from a front side of the refrigerator, a portion to which the second door 340 is connected may be covered to realize the sense of unity.

A protrusion 342 protruding inward may be disposed on a rear surface of the second door 340. A portion of the rear surface of the second door 340 may protrude to define the protrusion 342. Also, the protrusion 342 may have a shape corresponding to that of the opening 316. Thus, when the second door 340 is closed, the protrusion part 342 may be disposed inside the opening 316 and shapely coupled to the opening 316 to primarily prevent cool air from leaking.

An upper portion and a lower portion of the protrusion 342 may be stepped from each other. The lower protrusion 342*a* may be disposed on the stepped lower portion of the protrusion 342. The lower protrusion 342*a* may be disposed at a position lower than that of an upper portion of the protrusion 342. Also, the lower protrusion 342*a* may extend up to a lower end of the upper portion of the protrusion 342. When the second door 340 is closed, a folded shelf 370 may be disposed on the lower protrusion 342*a*. Thus, the protrusion 342 may have a thickness corresponding to that of the shelf 370.

A gasket 344 may be disposed along a circumference of the protrusion 342. The gasket 344 may be formed of a material such as rubber or silicon that can be elastically deformed. When the second door 340 is closed, the gasket 344 may be closely attached to the front surface of the refrigerating compartment door 30. At this time, the gasket 344 may be compressed to prevent cool air within the accommodation device 40 from leaking.

A second door switch for detecting the opening/closing of the second door 340 may be disposed on an upper end of the refrigerating compartment door 30. The second door switch may be configured to output an alarm signal to the outside when the second door 340 is not closed.

A locking unit may be disposed a side end of the rear surface of the second door 340 far away from a rotation shaft of the second door 340 and a side end of the refrigerating compartment door 30 corresponding to the side end of the rear surface of the second door 340. The locking unit may maintain the closed state of the second door 340 and switch a restricted state of the second door 340 by a pressing operation to selectively restrict the second door 340.

The locking unit may have the same structure as that of a general push switch. Also, the locking unit may include a locking device disposed on a side of the refrigerating compartment door 30 and including a latch slot 317 in which a latch hook 341 is inserted and the latch hook 341 disposed on the second door 340. Since the locking unit has a structure that is widely used in a general refrigerator, detailed descriptions with respect to the structure will be omitted.

A shelf 370 that is rotatable in a front direction may be disposed on a side of the first door 310. A connection assembly 390 connecting the shelf 370 to the second door 340 may be disposed on a side of the second door 340. Thus, the rotation of the shelf 370 may be associated with the opening/closing of the second door 340.

Hereinafter, the shelf 370 will now be described in more detail with reference to the accompanying drawings.

Figure 4:
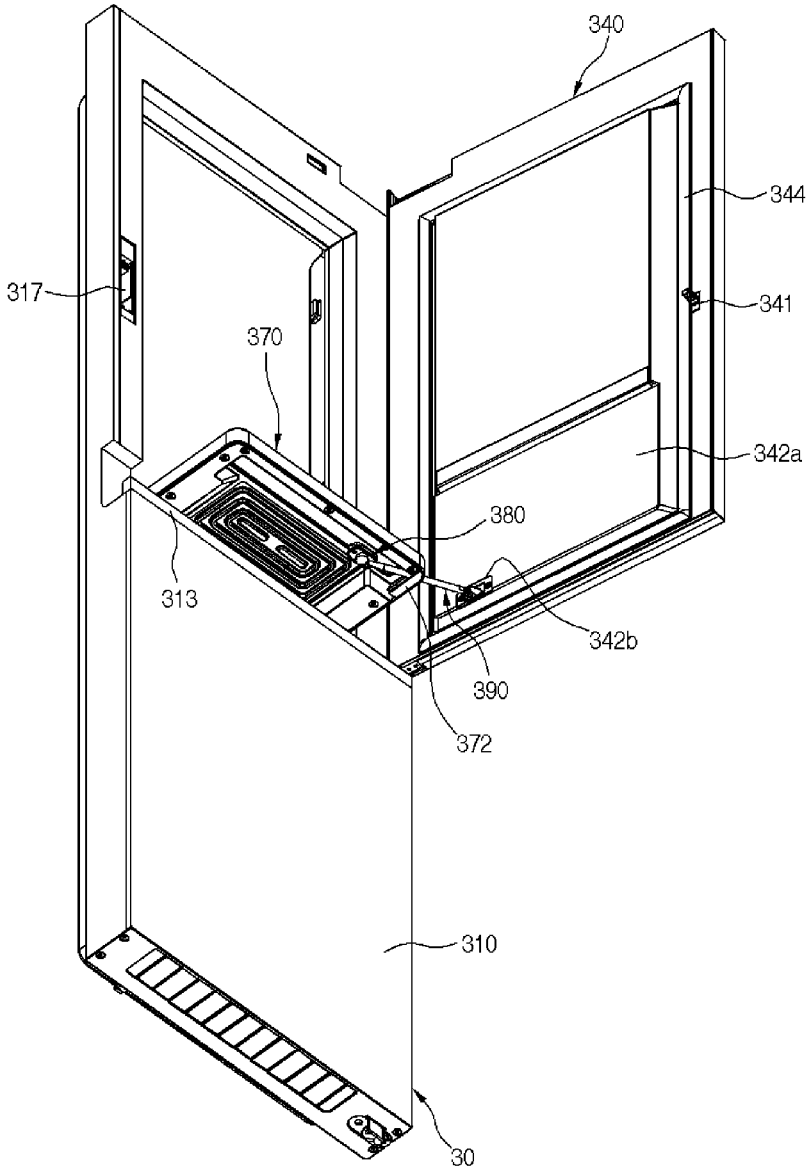
FIG. 4 is a view illustrating a state in which a shelf is rotated by opening the second door.

FIG. 4 is a view illustrating a state in which a shelf is rotated by opening the second door.

Figure 5:
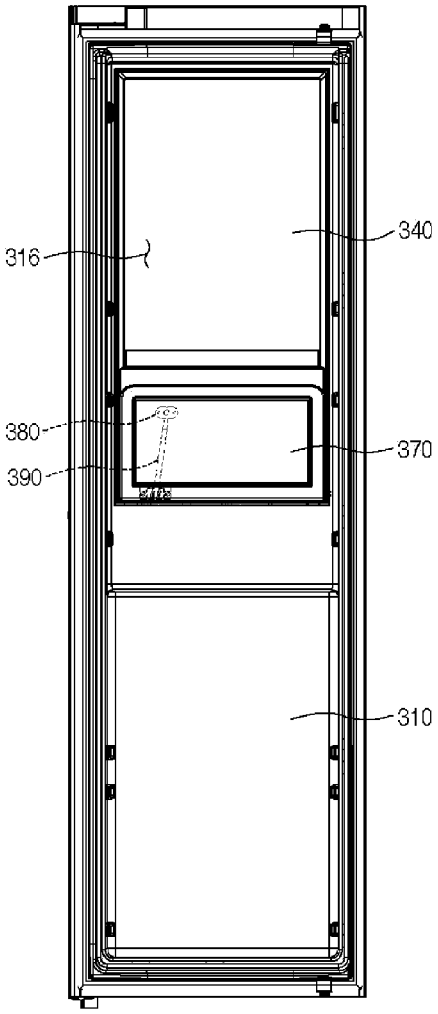
FIG. 5 is a view illustrating a rear surface of the first door in a state where the second door is closed.
Figure 6:
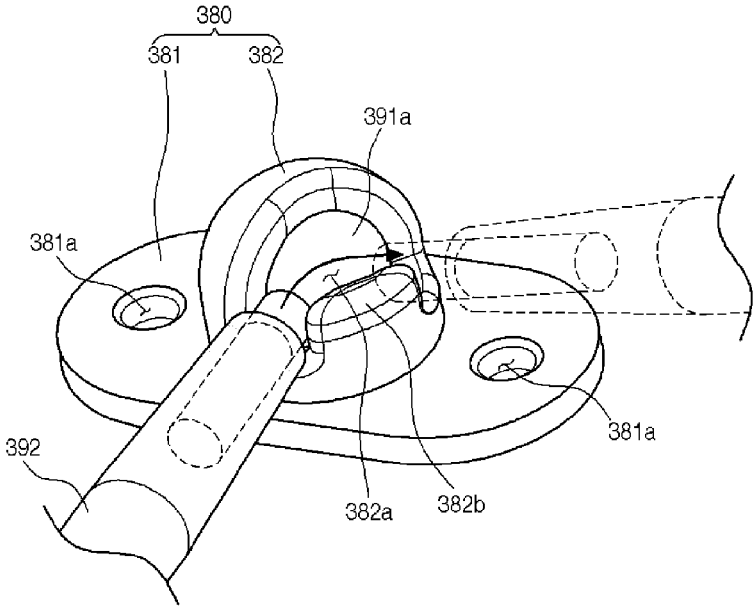
FIG. 6 is a view illustrating a state in which a joint member and a connection assembly are coupled to each other according to an embodiment.

FIG. 5 is a view illustrating a rear surface of the first door in a state where the second door is closed. FIG. 6 is a view illustrating a state in which a joint member and a connection assembly are coupled to each other according to an embodiment.

Referring to FIGS. 3 to 6, both ends of the shelf 370 may be shaft-coupled to the inside of the opening 316 so that it is rotatable while crossing the front surface of the first door 310. A shelf rotation shaft 371 may be disposed on each of both left and right sides of the shelf 370. The shelf rotation shafts 371 may be shaft-coupled to both left and right sides of a lower end of the opening, respectively. Here, the shelf rotation shaft 371 may be disposed on at least one side of the shelf 370 or the opening 316.

The shelf 370 may have a size corresponding to a horizontal width of the opening 316 so that the shelf 370 can be received into the opening 316. Also, the shelf 370 may have a size corresponding to that of the lower protrusion 342*a* so that the shelf 370 can be received into the lower protrusion 342*a* when the second door 340 is closed, as shown in FIG. 5.

A joint member 380 to which a connection assembly 390 that will be described below in detail is coupled may be disposed on a bottom surface of the shelf 370. The joint member 380 may include a joint coupling part 381 that is coupled to the shelf 370 and a joint receiving part 382 in which an end of the connection assembly 390 is rotatably received.

In detail, the joint coupling part 381 has a plate shape. Also, screw holes 381*a* are respectively defined in both sides of the joint coupling part 381 so that the joint coupling part 381 is coupled to the shelf 370. Thus, the joint member 380 is mounted on the shelf 370 by screws coupled to the screw holes 381*a*.

The joint receiving part 382 may receive a ball-shaped ball connection part 391*a* constituting the connection assembly 390 to surround the ball connection part 391*a*. A bottom surface of the joint coupling part 381 corresponding to the joint receiving part 382 may be opened so that the ball connection part 391*a* is inserted. Also, a cutout part 382*a* that is cut to guide a path in which a rod 392 is rotated may be disposed on a side of the joint receiving part 382.

Figure 7:
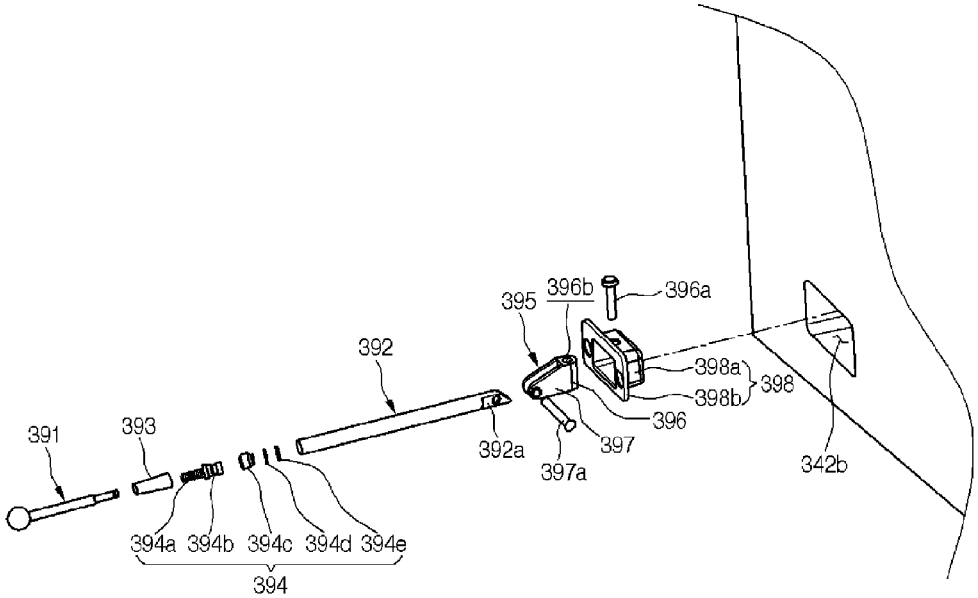
FIG. 7 is an exploded perspective view of the connection assembly according to an embodiment.

The cutout part 382*a* may allow a joint rod 391 to be freely rotated and prevent the ball connection part 391*a* from being separated from the joint receiving part 382. A guide part 382*b* protrudes from a side of the cutout part 382*a*. The guide part 382*b* protrudes from the cutout part 382*a* to define a predetermined path on the cutout part 382*a*. Also, when the joint rod 391 is rotated, the guide part 382*b* guides movement of the joint rod 391. As shown in FIG. 7, the ball connection part 391*a* may be received into both ends of the cutout part 382*a* to allow the ball connection part 391*a* to maintain a stable position thereof. Here, the ball connection part may be disposed on both ends of the cutout part 382*a* when the shelf 370 is completely folded or spread.

A restriction member 372 for restricting the connection assembly 390 may be further disposed on a side of the shelf 370. The restriction member 372 is disposed on a bottom surface of the shelf 370. Also, the restriction member 372 may define a space spaced from the bottom surface of the shelf 370. A side of the connection assembly 390 may be received between the shelf 370 and the restriction member 372 to prevent the connection assembly 390 from being moved into an undesired position when the shelf 370 is rotated.

A connection assembly mounting part 342*b* may be disposed on a lower side of the rear surface of the second door 340. The connection assembly mounting part 342*b* may be disposed on the lower protrusion 342*a* of the second door 340. The connection assembly mounting part 342*b* may be recessed to receive an end of the connection assembly 390. Also, the connection member 395 may be vertically shaft-coupled to the connection assemble mounting part 342*b* so that it 395 is rotatable in the same rotation direction as that of the second door 340.

Hereinafter, the connection assembly will be described in more detail with reference to the accompanying drawings.

Figure 8:
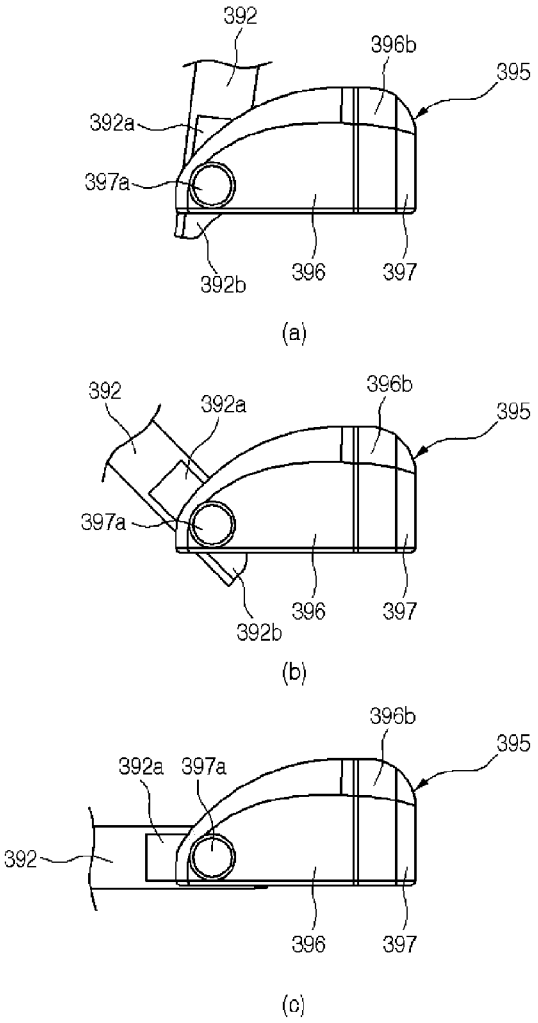
FIG. 8 is a view illustrating an operation of the connection assembly.

FIG. 7 is a view illustrating a state in which a joint member and a connection assembly are coupled to each other according to an embodiment. FIG. 8 is a view illustrating an operation of the connection assembly.

Referring to FIGS. 7 and 8, the connection assembly 390 includes the joint rod 391 connected to the joint member 380, a damping unit 394 that adjusts the length of the joint rod 391 and absorbs shock during the movement of the joint rod 391, a mounting member 398 mounted on the connection assembly mounting part 342*b* of the second door 340, a connection member 395 rotatably coupled to the mounting member 398, and a rod 392 that connects the joint rod 391 to the connection member 395.

In detail, the joint rod 391 may have a rod shape having a predetermined length. The ball connection part 391*a* having a ball shape may be disposed on an end of the joint rod 391. Thus, the ball connection part 391*a* may be rotatably coupled to the joint member 380. The other end of the joint rod 391 may be inserted into the rod 392. The joint rod 391 may be taken in and out of the rod 392 according to movement paths of the connection assembly 390 during the rotation of the shelf 370.

The rod 392 may receive an end of the joint rod 391 and may be shaft-coupled to the connection member 395. In detail, at least inner portion of the rod 392 may be hollowed to define a space for receiving the joint rod 391 and the damping unit 394. A rod cap 393 in which the joint rod 391 is inserted may be disposed on an end of the rod 392. The rod cap 393 may be coupled to the end of the rod 392. Both ends of the rod cap 393 may be opened to receive the joint rod 391 and at least one portion of the damping unit 394. A rod connection part 392*a* may be disposed on the other end of the rod 392. The rod connection part 392*a* may be received inside the connection member 395. The rod connection part 392*a* may be coupled to a side of the connection member 395 by a rod shaft 397*a* to allow the rod 392 to be vertically rotated with respect to the rod shaft 397*a*.

An end of the rod connection part 392*a* may have a curved surface 392*b* having a predetermined curvature as shown in FIG. 8. Thus, even though a user's hand contacts the rod connection part 392*a* when the rod 392 is rotated according to the rotation of the second door 340, the hand may be not caught to the rod connection part 392*a* and slip along the curved surface, thereby preventing a negligent accident from occurring.

The damping unit 394 may be disposed inside the rod 392 and support an end of the joint rod 391 to absorb the shock caused by the movement of the joint rod 391. The damping unit 394 may include a spring 394*a* supporting an end of the joint rod 391, a stopper 394*b* that slides within the rod 392 and supports the spring 394*a*, an 0-ring 394*c* mounted on the stopper 394*b* and contacting an inner surface of the rod 392 to provide a frictional force, a washer 394*d* mounted on the stopper 394*b* to prevent the O-ring from being separated, and a snap ring 394*e* fixing the washer 394*d* and prevent the stopper 394*b* from being moved back.

Thus, when the shelf 370 is rotated, the joint rod 391 may be taken in or out to smoothly rotate the shelf 370. When the joint rod 391 is moved while being taken in and out, the spring 394*a* may be extended or compressed. Accordingly, the stopper 394*b* may be moved to absorb shock transmitted from the joint rod 391, thereby decreasing a movement speed of the joint rod 391.

Since the joint rod 391 is decelerated, a sudden rotation of the shelf 370 may be prevented.

Although the damping unit 394 is disposed on the end of the rod 392 in the current embodiment, the present disclosure is not limited thereto. For example, the damping unit 394 may be disposed on both ends of the rod 392 so that the rod 392 may experience stroke variations at both ends of the rod 392.

The mounting member 398 is inserted in the connection assembly mounting part 342*b*. The mounting member may include a cup 398*a* that defines a receiving space for the connection member 395 and a flange 398*b* disposed around the cup 398*a* and coupled to the second door 340 through a screw.

A connection member rotation shaft 396*a* may be disposed in the cup 398*a* to vertically pass through the cup 398*a*. The connection member rotation shaft 396*a* may vertically pass through the connection member 395 received into the cup 398*a* to serve as a rotation center of the connection member 395.

The connection assembly 390 may be smoothly rotated by the connection member 395. The connection member 395 may include a shaft coupling part 396 in which the connection member rotation shaft 396*a* is inserted and a rod connection part receiving part 397 receiving the rod connection part 392*a*. A shaft insertion hole 396*b* vertically opened may be defined in the shaft coupling part 396. The connection member rotation shaft 396*a* may be inserted into the shaft insertion hole 396*b* to rotate the connection member 395 with respect to the connection member rotation shaft 396*a*. The rod 392 may be received within the rod connection part receiving part 397. Thus, the rod connection part receiving part 397 may be disposed on both sides of the rod 392 to move the rod 392 up and down. The rod shaft 397*a* may pass through the rod connection part receiving part 397 and the rod connection part 392*a* to enable the vertical movement of the rod 392.

Thus, the rod 392 may be freely rotated in vertical and horizontal directions, i.e., the rotation direction of the second door 340 and a direction crossing the rotation direction of the second door 340 by the connection member 395. Thus, when the second door 340 is opened or closed, the second door 340 may be further smoothly rotated during the folding or spreading of the shelf 370.

Hereinafter, a lower hinge assembly disposed on the second door will be described.

Figure 9:
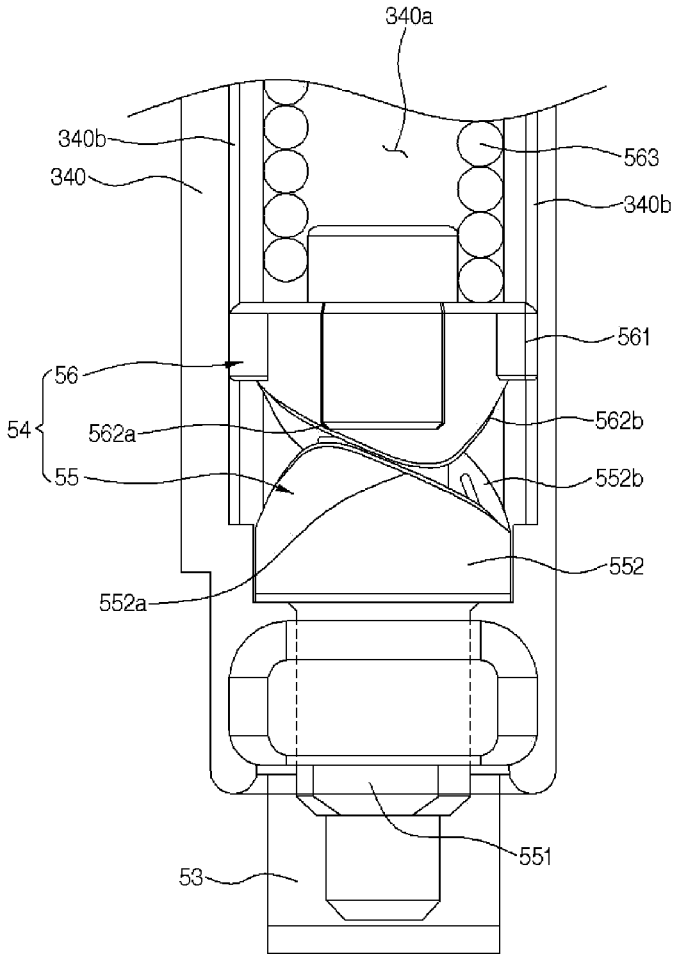
FIG. 9 is a view of a lower hinge assembly in a state where the second door is closed.
Figure 10:
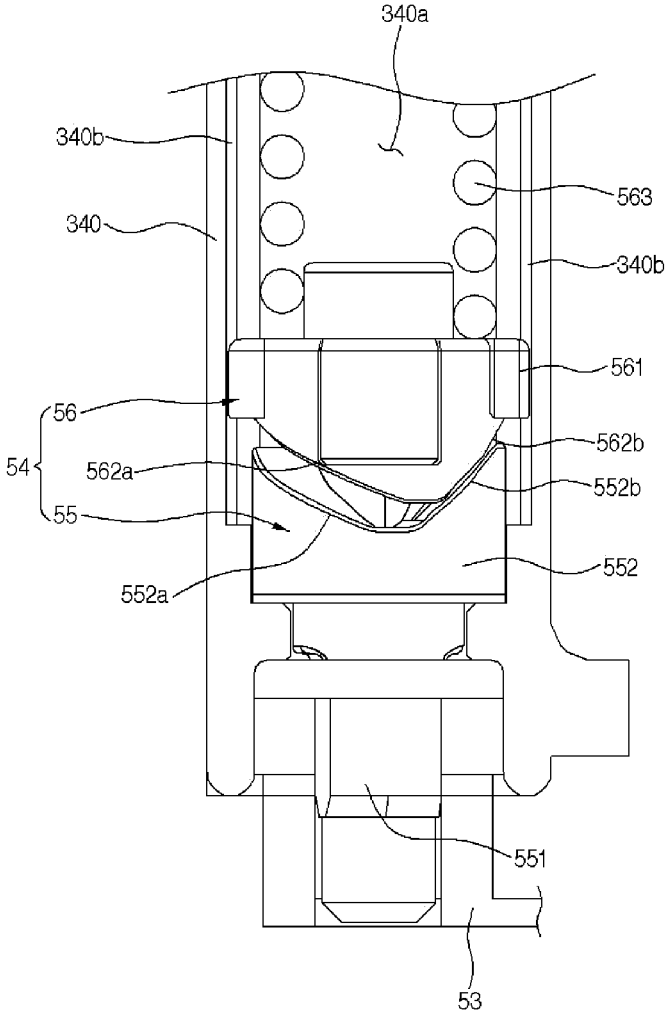
FIG. 10 is a view of the lower hinge assembly in a state where the second door is opened.

FIG. 9 is a view of a lower hinge assembly in a state where the second door is closed. FIG. 10 is a view of the lower hinge assembly in a state where the second door is opened.

Referring to FIGS. 9 to 10, a lower end of the second door 340 is supported by a hinge bracket 53. The hinge bracket 53 may be disposed on a front surface of the first door 310 to support the second door 340 from a lower side. Also, the hinge bracket 53 may be coupled to a lower hinge assembly 54 disposed to the second door 340.

When the second door 340 is opened, the lower hinge assembly 54 may automatically open the second door 340 at a predetermined angle and then prevent the second door 340 from being further rotated after the second door 340 is rotated at the predetermined angle.

In detail, the lower hinge assembly 54 includes a hinge fixing part 55 fixed to the hinge bracket 53 and a hinge rotation part 56 contacting the hinge fixing part 55 and fixedly disposed inside the second door 340 so that it 56 is rotated together with the second door 340 when the second door 340 is rotated.

The hinge fixing part 55 may include an insertion projection 551 inserted into the hinge bracket 53 and a lower cam 552 disposed above the insertion projection 551. The insertion projection 551 may have a shape corresponding that the hinge bracket 53 is fixed and thus be shapely coupled to the hinge bracket 53. Thus, the hinge fixing part 55 may be maintained in a state it is fixed to the hinge bracket 53 when the second door 340 is rotated. A first cam surface 552*a* inclined downward may be disposed on a top surface of the lower cam 552. Also, a second cam surface 552*b* inclined again from a lower end of the first cam surface upward may be disposed on the top surface of the lower cam 552. The first cam surface 552*a* may be continuously connected to the second cam surface 552*b*. Also, two first and second cam surfaces 552*a* and 552*b* may be continuously provided along a circumference of the top surface of the lower cam 552.

A fixing projection 561 may be disposed around a side surface of the hinge rotation part 56. The hinge rotation part 56 may be disposed within the hinge receiving part 340*a* mounted inside the second door 340. A projection receiving groove 340*b* may be recessed around an inner surface of the hinge receiving part 340*a*. The fixing projection 561 may be received within the projection receiving groove 340*b*. Thus, the hinge rotation part 56 may be mounted in a state where it is integrally rotated with the second door 340. An upper cam 562 is disposed on a bottom surface of the hinge rotation part 56. The upper cam 562 has a third cam surface 562*a* inclined downward and a fourth cam surface 562*b* inclined again from a lower end of the third cam surface 562*a* upward. The third cam surface 562*a* may be continuously connected to the fourth cam surface 562*b*. Also, two third and fourth cam surfaces 562*a* and 562*b* may be continuously provided along a circumference of the upper surface of the lower cam 552. The third and fourth cam surfaces 562*a* and 562*b* contact the first and second surfaces 552*a* and 552*b* in corresponding shapes, respectively.

The upper surface of the hinge rotation part 56 may be supported by an elastic member 563 such as a spring disposed within the hinge receiving part 340*a*. Thus, the lower surface of the hinge rotation part 56 may continually contact the upper surface of the hinge fixing part 55. Also, the first and second cam surfaces 552*a* and 552*b* of the hinge fixing part 55 and the third cam surface 552*a* and 562*b* of the hinge rotation part 56 may be moved according to the rotation of the second door 340 while contacting the second and fourth cam surfaces 552*b* and 562*b*.

For example, in the state where the second door 340 is closed, the first and second cam surfaces 552*a* and 562*a* may contact each other as shown in FIG. 9. When the first cam surface 552*a* and the third cam surface 562*a* are inclined downward to release the restriction of the second door 340, the third cam surface 562*a* may slip downward along the first cam surface 552*a* by a self-weight of the second door 340. Thus, when the second door 340 is opened, the latch hook 341 may be released to open the second door 340 using the self-weight of the second door 340 without applying an additional force.

When the second door 340 is rotated at an angle greater than a predetermined angle during the opening thereof, the first and third cam surfaces 552*a* and 562*a* may not contact each other, but the second and fourth can surfaces 552*b* and 562*b* may contact each other. Since the second and fourth cam surfaces 552*b* and 562*b* are inclined downward, the more the second door 340 is rotated, the more the rotation speed of the second door 340 may be decreased.

When the second door 340 is rotated at a predetermined angle, for example, about 110°, the second cam surface 552*b* may completely contact the fourth cam surface 562*b* as shown in FIG. 10. Also, the elastic member 563 may be compressed to prevent the hinge rotation part 56 from being further rotated. In this state, the rotation of the second door 340 may be stopped and restricted.

The degree of the opening of the second door 340 may be determined by the curvatures of the second and fourth cam surfaces 552*b* and 562*b* and the elasticity of the elastic member 563. However, considering the shelf 370 linked with the rotation of the second door 340, the second door may be opened at an angle of about 110°.

Hereinafter, an operation of the second door of the refrigerator will be described according to an embodiment.

When the second door 340 is closed, the shelf 370 may be closely attached to the lower protrusion 342*a* in the folded state. Also, in the state where the shelf 370 is folded, the connection assembly 390 may be also folded.

When the second door 340 is closed, the user may manipulate the opening of the second door 340 by releasing the restriction of the latch hook 341. While the restriction of the latch hook 341 is released, the second door 340 may be automatically rotated by the lower hinge assembly 54.

Also, the shelf 370 connected to the connection assembly 390 may be spread while the second door 340 is rotated. The connection assembly 390 may be rotated together with the shelf 370. Here, the shelf 370 is slowly moved downward by the damping of the damping unit 394.

The second door 340 is automatically opened by the lower hinge assembly 54 at a predetermined angle. Then, when the shelf 370 is completely spread so that the top surface of the shelf 370 is perpendicular to the front surface of the first door 310, the rotation of the second door 340 may be stepped. At this time, the second door 340 may be rotated at an angle of about 110° and the second door 340 may be gradually decelerated by the lower hinge assembly 54 and stopped just before the shelf 370 is completely spread.

When the shelf 370 is completely spread, the connection assembly 390 may be also completely spread to support the shelf 370. At the same time, the lower surface of the shelf 370 may be supported by the lower end of the opening 316. Thus, the shelf 370 may be maintained in a stable state. When the shelf 370 is completely spread, the joint rod 391 of the connection assembly 390 may be maintained to be received into the end of the cutout part 382*a* of the joint member 380. In addition, since the second door 340 is not further opened by the lower hinge assembly 54, the shelf 370 may be maintained in the more stable state.

INDUSTRIAL APPLICABILITY

According to the embodiments, since the shelf is spread by being linked with the opening of the second door, the convenience of use may be further improved and industrial applicability may be high.

The invention claimed is:

1. A refrigerator comprising:

a cabinet;

a storage compartment within the cabinet;

a first door configured to open and close the storage compartment;

an accommodation device that defines an accommodation space opened toward a front surface of the first door and that is configured to move with the first door when the first door rotates between opened and closed positions;

a second door that is disposed on the first door, that is configured to open and close the accommodation device, and that enables access to the accommodation space when the first door is oriented in a closed position;

a shelf that is disposed on the first door, that is configured to, when the second door opens, rotate from a stored position located within the accommodation space to a supporting position extended out of the accommodation space, and that is configured to, when the second door closes, rotate from the supporting position to the stored position;

a connection assembly that connects the shelf to the second door, that is configured to, when the second door opens, cause the shelf to rotate from the stored position to the supporting position, and that is configured to, when the second door closes, cause the shelf to rotate from the supporting position to the stored position; and a damping unit configured to absorb shock of the shelf during rotation of the shelf to reduce a rotation speed of the shelf, wherein the refrigerator further comprises a ball-shaped joint member located at a first end of the connection assembly and coupled to a bottom surface of the shelf, and wherein the first end of the connection assembly is rotatably coupled to the shelf by the joint member and a second end of the connection assembly is rotatably coupled to the second door.

2. The refrigerator according to claim 1, wherein both left and right side surfaces of the shelf are shaft-coupled to an opening defined in the accommodation device.

3. The refrigerator according to claim 1, wherein the second door has a shelf receiving part stepped to receive the shelf when the shelf is oriented in the stored position.

4. The refrigerator according to claim 1, wherein the connection assembly has a variable length.

5. The refrigerator according to claim 1, wherein the connection assembly comprises:

a joint rod rotatably coupled to the joint member;

a connecting rod in which the joint rod is received;

a mounting member mounted on the second door; and a connection member rotatably connected to the mounting member and the connecting rod.

6. The refrigerator according to claim 5, wherein the connection member comprises:

a connection member rotation shaft that connects the mounting member to the connection member and that rotates the connection member in a same direction as that in which the second door is rotated; and a rod shaft that connects the connection member to the connecting rod and that rotates the connecting rod in a direction perpendicular to a direction in which the second door rotates.

7. The refrigerator according to claim 1, further comprising a lower hinge assembly disposed on a rotation shaft of the second door, the lower hinge assembly being rotated along an inclined cam surface by weight of the second door when the second door opens.

8. The refrigerator according to claim 7, wherein the lower hinge assembly comprises:

a hinge fixing part that is fixed to an extending line of the rotation shaft of the second door;

a hinge rotation part that is configured to move vertically above the hinge fixing part, the hinge rotation part being rotated together with the second door; and an elastic member that supports the hinge rotation part upward, the elastic member providing an elasticity to maintain a contact state between the hinge rotation part and the hinge fixing part.

9. The refrigerator according to claim 8, wherein first and third cam surfaces inclined downward are disposed on the hinge fixing part and the hinge rotation part, respectively, and the first and second cam surfaces contact each other in a state in which the second door is closed to rotate the second door by weight of the second door during the opening of the second door.

10. The refrigerator according to claim 8, wherein second and fourth cam surfaces inclined upward are disposed on the hinge fixing part and the hinge rotation part, respectively, and the second and fourth cam surfaces contact each other when the second door is opened at an angle greater than a preset angle to reduce and restrict the rotation of the second door.

11. The refrigerator according to claim 1, wherein the first door and the second door rotate in a same direction and the shelf rotates in a direction that is perpendicular to the same direction in which the first door and the second door rotate.

12. The refrigerator according to claim 1, wherein the accommodation device comprises a housing that is detachably coupled to the first door and that defines the accommodation space.

13. The refrigerator according to claim 1, wherein the first door comprises a horizontal recess that is defined at a center portion of the first door and that provides a handle that enables a user to pull open the first door.

14. The refrigerator according to claim 1, wherein the second door aligns with an uppermost edge of the first door when the second door is oriented in a closed position and a height of the second door is about half of a height of the first door.

15. The refrigerator according to claim 1, further comprising a gasket provided on at least one of a rear surface of the second door and a front surface of the accommodation device and configured to seal the accommodation space when the second door is oriented in a closed position.

16. The refrigerator according to claim 1, further comprising:

a first hinge that attaches an upper portion of the second door; and a second hinge that attaches a lower portion of the second door to a center portion of the first door.

* * * * *